US007464645B2

(12) United States Patent
Jeschonneck et al.

(10) Patent No.: US 7,464,645 B2
(45) Date of Patent: Dec. 16, 2008

(54) PRINTING MACHINES HAVING AT LEAST ONE MACHINE ELEMENT THAT CAN BE ADJUSTED BY A SETTING ELEMENT

(75) Inventors: Harald Heinz Peter Jeschonneck, Thüngersheim (DE); Stefan Arthur Budach, Detmold (DE); Thomas Türke, Bielefeld (DE); Harald Heinrich Willeke, Paderborn (DE); Andreas Ewald Heinrich Bernard, Sulzfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 288 days.

(21) Appl. No.: 10/594,224

(22) PCT Filed: Mar. 17, 2005

(86) PCT No.: PCT/EP2005/051234

§ 371 (c)(1),
(2), (4) Date: Sep. 25, 2006

(87) PCT Pub. No.: WO2005/092613

PCT Pub. Date: Oct. 6, 2005

(65) Prior Publication Data

US 2007/0144375 A1 Jun. 28, 2007

(30) Foreign Application Priority Data

Mar. 23, 2004 (DE) ..... 10 2004 014 533
Jul. 23, 2004 (DE) ..... 10 2004 035 787
Oct. 8, 2004 (DE) ..... 10 2004 049 079

(51) Int. Cl.
*B41F 31/00* (2006.01)

(52) U.S. Cl. ..... 101/484; 101/487

(58) Field of Classification Search ..... 101/147, 101/148, 211, 228, 248, 483, 484, 485, 487; 382/112
See application file for complete search history.

(56) References Cited

U.S. PATENT DOCUMENTS 4,335,634 A * 6/1982 Larson ..... 83/13

(Continued)

FOREIGN PATENT DOCUMENTS

DE 1 241 464 12/1960

(Continued)

*Primary Examiner*—Daniel J Colilla
*Assistant Examiner*—David Banh
(74) *Attorney, Agent, or Firm*—Jones, Tullar & Cooper, P.C.

(57) ABSTRACT

A printing machine has at least one machine element which can be adjusted by the use of a setting element. An adjustment of the one machine element has an effect on the quality of the printing performed by the printing machine. An optical detection device, which includes a sensor that is oriented toward the surface of a material which is being printed, detects the quality of the printing. A controlling device receives data from the optical sensor and adjusts, together with the setting element, the at least one machine element based on a difference between a quality of the printing which has been specified as a set value and the quality of the printing detected as an actual value by the optical detection device. This adjustment is done to manage the differences between the set value and the actual value. The control is based on the fact that the quality of the printing is detected in its entirety by the optical detection device and the data is evaluated with regard to disturbing influences acting upon the quality of the printing.

15 Claims, 3 Drawing Sheets

U.S. PATENT DOCUMENTS

| | | | | |
|---|---|---|---|---|
| 4,534,289 | A | 8/1985 | Durrnagel et al. | |
| 4,847,775 | A | 7/1989 | Roch et al. | |
| 5,258,925 | A | 11/1993 | Maier et al. | |
| 5,452,632 | A | 9/1995 | Durr et al. | |
| 5,500,801 | A | 3/1996 | Loffler | |
| 5,546,861 | A | 8/1996 | Loffler | |
| 5,694,848 | A | 12/1997 | Palmatier | |
| 5,724,437 | A * | 3/1998 | Bucher et al. | 382/112 |
| 5,740,054 | A | 4/1998 | Durr et al. | |
| 5,802,978 | A | 9/1998 | Geissler et al. | |
| 6,243,547 | B1 * | 6/2001 | Mizuno et al. | 399/69 |
| 6,433,805 | B1 * | 8/2002 | Snelling | 347/156 |
| 6,450,097 | B1 | 9/2002 | Kistler et al. | |
| 6,584,900 | B2 * | 7/2003 | De Vroome | 101/228 |
| 6,644,184 | B1 | 11/2003 | Hajek et al. | |
| 6,647,874 | B1 | 11/2003 | Siegl et al. | |
| 6,782,814 | B2 | 8/2004 | Tokiwa | |
| 6,796,227 | B1 | 9/2004 | Miller | |
| 6,796,240 | B2 | 9/2004 | Sainio et al. | |
| 6,847,791 | B2 * | 1/2005 | Kitagawa et al. | 399/49 |
| 7,004,070 | B2 | 2/2006 | Schneider et al. | |
| 7,021,215 | B2 | 4/2006 | Schneider et al. | |
| 7,296,717 | B2 * | 11/2007 | Swanson et al. | 226/3 |
| 2003/0010236 | A1 | 1/2003 | De Vroome | |
| 2003/0122914 | A1 * | 7/2003 | Kusaka | 347/104 |

FOREIGN PATENT DOCUMENTS

| | | | |
|---|---|---|---|
| DE | 37 30 625 | | 3/1989 |
| DE | 43 02 149 | | 7/1994 |
| DE | 44 13 735 | | 10/1995 |
| DE | 195 33 822 | | 3/1997 |
| DE | 197 24 171 | | 10/1997 |
| DE | 44 13 731 | | 7/1998 |
| DE | 197 36 339 | | 4/1999 |
| DE | 198 30 490 | | 5/1999 |
| DE | 199 17 773 | | 11/1999 |
| DE | 199 10 835 | | 9/2000 |
| DE | 100 13 876 | | 10/2000 |
| DE | 100 30 572 | | 1/2002 |
| DE | 102 18 359 | | 11/2003 |
| EP | 0 722 831 | A2 | 4/1993 |
| EP | 0 722 831 | A3 | 4/1993 |
| EP | 0 598 490 | | 5/1994 |
| EP | 0 649 744 | | 4/1995 |
| EP | 0 763 426 | | 9/1996 |
| EP | 0 767 059 | A2 | 10/1996 |
| EP | 0 767 059 | A3 | 10/1996 |
| EP | 0 835 755 | A2 | 10/1997 |
| EP | 0 835 755 | A3 | 10/1997 |
| EP | 0 882 588 | | 5/1998 |
| EP | 1 048 461 | | 4/2000 |
| EP | 1 172 204 | | 9/2000 |
| EP | 1 167 035 | A2 | 6/2001 |
| EP | 1 167 035 | A3 | 6/2001 |
| EP | 1 512 531 | | 3/2005 |
| FR | 2 391 073 | | 2/1978 |
| GB | 2 119 505 | | 11/1983 |
| GB | 2 209 853 | | 5/1989 |
| WO | WO 2005/016806 | | 2/2005 |

* cited by examiner

PRINTING MACHINES HAVING AT LEAST ONE MACHINE ELEMENT THAT CAN BE ADJUSTED BY A SETTING ELEMENT

CROSS REFERENCE TO RELATED APPLICATIONS

This application is a US National Phase filing under 35 U.S.C. 371 of International Application No. PCT/EP2005/051234, which was filed on Mar. 17, 2005 and claims priority on DE 10 2004 014 533.4, filed Mar. 23, 2004, DE 10 2004 035 787.0, filed Jul. 23, 2004 and DE 10 2004 049 079.1, filed Oct. 8, 2004, all of which are incorporated by reference in their entirety.

BACKGROUND OF THE INVENTION

1. Field of the Invention

The present invention relates to printing machines having at least one machine element that can be adjusted using a setting element, to affect a quality of a printing performed by the printing machine, wherein an optical detection device having a sensor that is directed toward a surface of a printing substrate printed in the printing machine detects the quality of the printing during the transport of the printing substrate through the printing machine, and wherein a control device that receives data from the optical detection device uses the setting element to adjust the at least one machine element based upon a difference between a quality of the printing that is preset as the target value and the quality of the printing that is detected by the optical detection device as the actual value, in a manner that serves to minimize the difference between the target value and the actual value.

2. Description of the Background Art

EP 0 763 426 B1 and DE 195 33 822 A1, which establishes the priority of the former publication, disclose a method for controlling inking in printing with a printing machine, especially a sheet-fed offset printing machine comprising multiple printing couples in which, for example, an imaging device is used to obtain actual colorimetric values for a multitude of selected measuring points distributed over the entire surface of an image substrate. These values are stored as reference values for at least one subsequent printing, wherein in the subsequent printing actual values are obtained at measuring points that coincide with the previously selected measuring points, wherein the inking in the print run is controlled only at those measuring points that change the most, by means of setting elements that act upon said measuring points. Elements for setting the coating thickness of the printing ink, for setting the quantity of dampening agent, and for setting the register, all of which are active in zones, are listed as setting elements. A control unit that controls the respective setting elements and an imaging device that scans the entire printed surface of a sheet are provided. Inputs into a data processing unit that is connected to the control unit can be accomplished via a keyboard.

EP 0 598 490 A1 discloses a color register system for a printing machine, wherein a computer uses a camera or a group of cameras to detect any misalignment of colors in a printed image by comparing a relevant image with a stored reference image, and uses a print controller to align a longitudinal, transverse and rotational position of cylinders in the printing machine relative to a web that is passed through the printing machine for printing, such that said cylinders will generate a multi-color image with colors that are aligned properly relative to one another.

EP 0 882 588 A1 discloses a device and a method for the register-true coordination of printing cylinders in a web-fed rotary printing machine, wherein a first cylinder that prints on one side of the web is actuated by a first motor and a second cylinder that prints on the same side of the web is actuated by a second motor. The angular position of the second cylinder is coordinated with the first cylinder via a controller to be register-true, wherein register marks printed on the web by the cylinders are scanned by a sensor, such as a CCD camera, which is positioned downstream from the last cylinder in the direction of production, and are evaluated for the controller using identifying characteristics as reference variables.

DE 197 36 339 A1 discloses a printing machine with impression cylinders designed for printing on a substrate and having an inking unit that comprises an ink fountain and is assigned to a forme cylinder, wherein temperature-control elements are allocated to at least one inking roller and preferably also to the forme cylinder. The temperature-control elements are equipped with a controlling or regulating device, in which, using preset values, reference temperature values for the printing ink can be adjusted for at least one inking roller, wherein the preset values can be based upon an optical density measured on the substrate using a photometric sensor or a densimeter, such as is customarily used in the printing industry, and can thus be derived especially from a printed image evaluation of printed samples drawn from a print run.

DE 102 18 359 A1 discloses a web-fed rotary printing machine comprising one printing couple with which printing ink can be applied to a substrate that passes through the printing couple, wherein a least one component that operates in conjunction with the printing ink and can be controlled via a temperature-control device is provided, wherein the tack of the printed ink in a specific area can be adjusted by said temperature-control device.

EP 1 512 531 A1, which was published subsequent to the priority date of the subject application, discloses a method and a device for controlling inking in a printing machine, wherein a color recognition device comprising a multitude of color sensors stationarily attached to the printing machine is provided for the whole-surface optical scanning of the entire width of the printed product in which one rapid primary color-measuring signal is scanned per color zone. Integration is performed along the print direction, over a color image range for the printed product that can be preset, wherein the total actual surface coverage is calculated for at least one printing ink, wherein a comparison with a reference surface coverage is made, and wherein a color correction signal is generated for the color zone and the printing ink.

WO 2005/016806 A1, which was published subsequent to the priority date of the subject application, discloses a method for regulating the cut-off register of a web-fed rotary printing machine, in which specific image data or measurement marks on printed webs are recorded by sensors and supplied to a regulating device. Before and/or on the common cutting cylinder, image information or a measurement mark from at least one of the printed webs that is applicable to the deviation in the position of the printed image relative to its reference position based upon the location and the time of the cut, in other words applicable to the cut-off register error, is recorded, evaluated and/or converted to an actual value with the help of at least one sensor. This actual value serves in regulating the cut-off register error of at least one web, and that for the correction of the cut-off register error of the at least one web either the speed of at least one clamping point that lies in front of the cutting cylinder and/or the position of the cutting cylinder is changed, so that the cut-off register error of the at least one web is corrected to a preset reference value on the basis of the actual value.

U.S. Pat. No. 6,796,227 B1, which was published subsequent to the priority date of the subject application, discloses a printing machine with multiple sequentially arranged printing couples, wherein a dampening unit is allocated to each of the printing couples. Each dampening unit dampens one printing forme that is arranged on a forme cylinder of the printing couples, in multiple zones in longitudinal rows along the forme cylinder, wherein in each of the zones a control device with a camera measures a color density of the printing ink that is applied to a printing substrate in the printing machine. The control device adjusts a metering of the dampening agent in the zones with the help of a correction signal that is derived from the measurement of the color density.

U.S. Pat. No. 6,796,240 B2, which was published subsequent to the priority date of the subject application, discloses a printing machine with multiple sequentially arranged printing couples, wherein the printing couples print different color patches of the same printed image, a control device uses a camera to scan a color-measuring bar applied to a printing substrate and the control device controls both a color register and a color density.

U.S. Pat. No. 6,782,814 B2, which was published subsequent to the priority date of the subject application, discloses a method and a device for detecting register errors and an automatic register control for a multicolor rotary printing machine, wherein register marks printed onto a paper web are scanned using a CCD camera, and the centers of gravity of the register marks are evaluated in comparison with a reference position.

The known devices for influencing a quality of printing essentially follow a singular approach to a solution, in that they view an individual interfering factor separately from its interaction with another interfering factor having a different cause. This does not adequately address what actually occurs in practice.

Clients ordering printed products are placing ever increasing demands on the quality of printed products created using printing machines, wherein the concept of the quality of a printing, through properties shown in samples of the printing, forms a complex level. This level is most frequently characterized by a multitude of parameters, which are to be achieved and maintained for all the copies of the printed product, to the greatest possible extent, by the party creating the printed product with the printing machine, optionally taking into account an agreed-upon permissible margin of error. Thus for financial reasons alone, it is necessary for the party performing the printing to minimize wasted paper from non-salable copies of the printing, both in the final proof and in the print run.

In the print run even high-precision machine elements of the printing machine are subject, for example, to changes caused by wear and tear, and even high-quality materials processed in the print run are subject, for example, to thermal changes. Thus, the structural dimensions of printing machines for the most part cannot alone guarantee a reproducibility of the copies that make up the printing. As a result, technical measures that constitute a component of the printing process are also necessary in order to ensure that the quality of the printed product promised to the client ordering the printing, and thereby the properties that define said quality, can be achieved and consistently maintained. These properties relate especially, for example, to the inking of the printed product, the scope of the tonal values reproduced in the printing, the sharpness and the contrast of printed halftone dots, the precision of the overprinting of color patches involved in the printing and belonging to a specific printed image, and the positioning accuracy of printed images printed on both sides of a printing substrate.

Each of these properties can be influenced in a sustained manner, alone or in combination, among other things by the properties of the materials used in the printing, for example the printing ink and/or the printing substrate, by their behavior as they are transported through the printing machine, and by the setting of machine elements involved in the printing and/or the temporal response to a change in their setting, in other words the time required to reach an operating state that is stable with respect to the printing process following a change in the setting of one or more machine elements. This approach results in a complex control system for the printing machine, in which the quality of the printing is viewed as a controlled process that inhibits interfering factors and must be regulated.

SUMMARY OF THE INVENTION

The object of the present invention is to create printing machines having at least one machine element that can be adjusted with a setting element, wherein a quality of the printing can be adjusted and will be stable at the adjusted level in the print run. The object is attained according to the invention though provision of printing machines wherein an optical detection device having a sensor that is directed toward a surface of a printing substrate printed in the printing machine detects the quality of the printing on the printing substrate transported through the printing machine. A control device receives data from the optical detection device and uses the setting element (to adjust the at least one machine element based upon a difference between a quality of the printing that is preset as the target value and the quality of the printing that is detected by the optical detection device as the actual value, in a manner that serves to minimize the difference between the target value and the actual value.

The optical detection device simultaneously detects two marks or measurement fields, which are arranged crosswise to the direction of transport of the printing substrate and are incongruent in a spacing or at least in their respective positions. Both the marks or measurement fields are simultaneously assigned to the same color patch so that when a difference is identified between the target value and the actual value, the control device uses the setting element to adjust the at least one machine element based upon an identified change in the spacing between the two marks or measurement fields, crosswise to the direction of transport of the printing substrate.

Additional machine elements are provided, each of which can be adjusted independently of one another by the control device using a setting element. The adjustment of the different machine elements serves to counteract interfering factors having different causes and different temporal behavior or different surface effects on the printing. When a difference between the target value and the actual value exists, the control device analyzes the data from the optical detection device with respect to the interfering factor causing the difference, its temporal behavior and/or its surface effect on the printing, and initiates the control operations necessary to achieve the quality of the printing to be produced, these control operations acting upon different ones of the machine elements.

The benefits that can be achieved with the invention consist especially in that a quality of the printing can be adjusted and can be maintained at the adjusted level in the print run. An interfering factor that negatively influences the quality of the printing is effectively counteracted in a synchronized manner, viewed with other interfering factors, as soon as the detection device detects the negative effect of the interfering factor on the quality of the printing. This is possible because the detection device is capable of detecting all interfering factors that affect the quality of the printing. A simultaneous detection of all interfering factors, both in real time and near the location at which the quality of the printing is produced, enables a rapidly effective control from an evaluation of the output signal from only one detection device, so that with respect to the printing, a stable operating state producing good quality can be achieved after only a very short time. The detection of the quality of the printing in its entirety, combined with an evaluation of the data that correlate with it with respect to multiple, preferably all, interfering factors that adversely affect the quality of the printing, means a substantial reduction of work for an operator operating the printing machine, as he/she is not required to monitor and/or operate a multitude of different control and/or regulating devices.

BRIEF DESCRIPTION OF THE DRAWINGS

Exemplary embodiments of the invention are illustrated in the set of drawings and will be described in greater detail in what follows.

DETAILED DESCRIPTION OF THE PREFERRED EMBODIMENT

Figure 1:
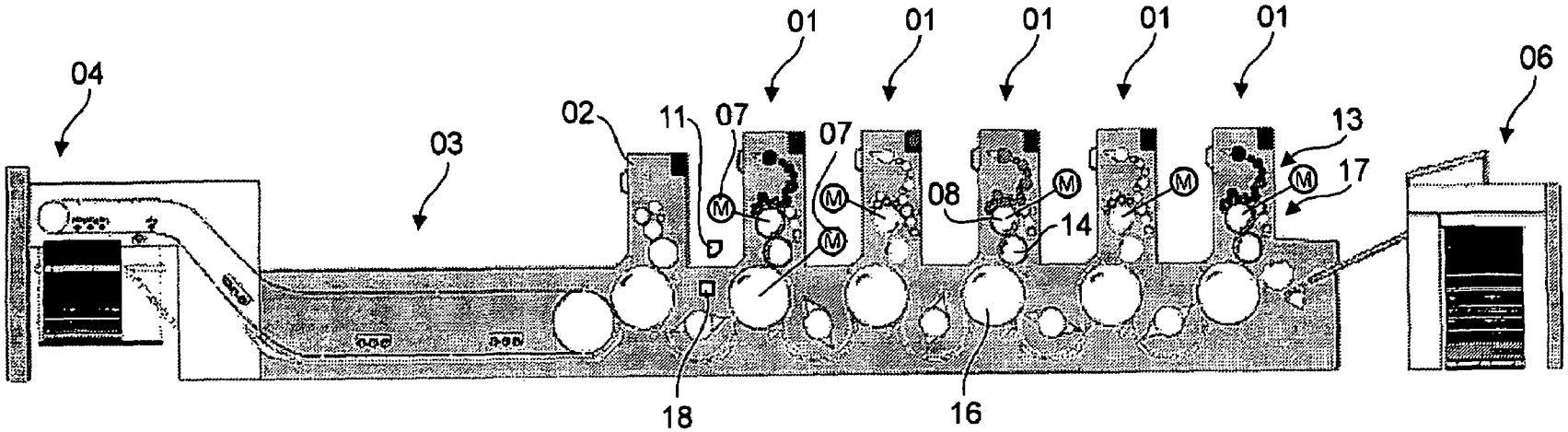
FIG. 1 a simplified illustration of a sheet-fed offset printing machine from a side view.

FIG. 1 shows a printing machine, which is designed by way of example as a sheet-fed printing machine. Alternatively, however, the printing machine may also be designed as a web-fed printing machine. The printing machine is designed especially as an offset printing machine. However, it may also be provided that the printing machine prints using a waterless offset printing process. The printing machine illustrated by way of example in FIG. 2 is a waterless printing machine, i.e. one that prints without the addition of a dampening agent.

The printing machine is preferably equipped with multiple printing couples 01, each of which prints on the same printing substrate with one printing ink. In the example in FIG. 1 five printing couples 01 are provided in the direction of transport of the printing substrate, arranged sequentially according to the unit construction principle. These are followed by a coating unit in the form of a tower coater 02, along with a delivery extension 03 and at least one delivery 04. A sheet-feed device 06 is arranged at the opposite end of the sheet-fed printing machine.

The number of sequentially arranged printing couples 01 can be lower or higher than in the illustrated example, as required. An expansion up to ten printing couples 01 is entirely possible. At least one of the multiple printing couples 01 can be designed as an imprinter, so that an in-process plate change, in other words a change of printing formes on one or more forme cylinders 08 while the printing machine is in a print run, is possible through a separation of the relevant forme cylinder 08 from the printing process underway. The sheet-fed printing machine can also be intended for straight and perfecting printing, i.e. for printing on both sides of the printing substrate that passes through the sheet-fed printing machine, and may be equipped, for example, with a turning device to allow realization of this function. The imprinter function can be provided for the straight and perfecting printing, i.e. on both sides of the printing substrate. Imprinter-capable printing units 01 can also be used to print decorative colors, etc. In addition to an arrangement of the printing couples 01 according to the unit construction principle, an arrangement in the form of a tower with an essentially vertical guidance of the printing substrate can also be provided.

Figure 2:
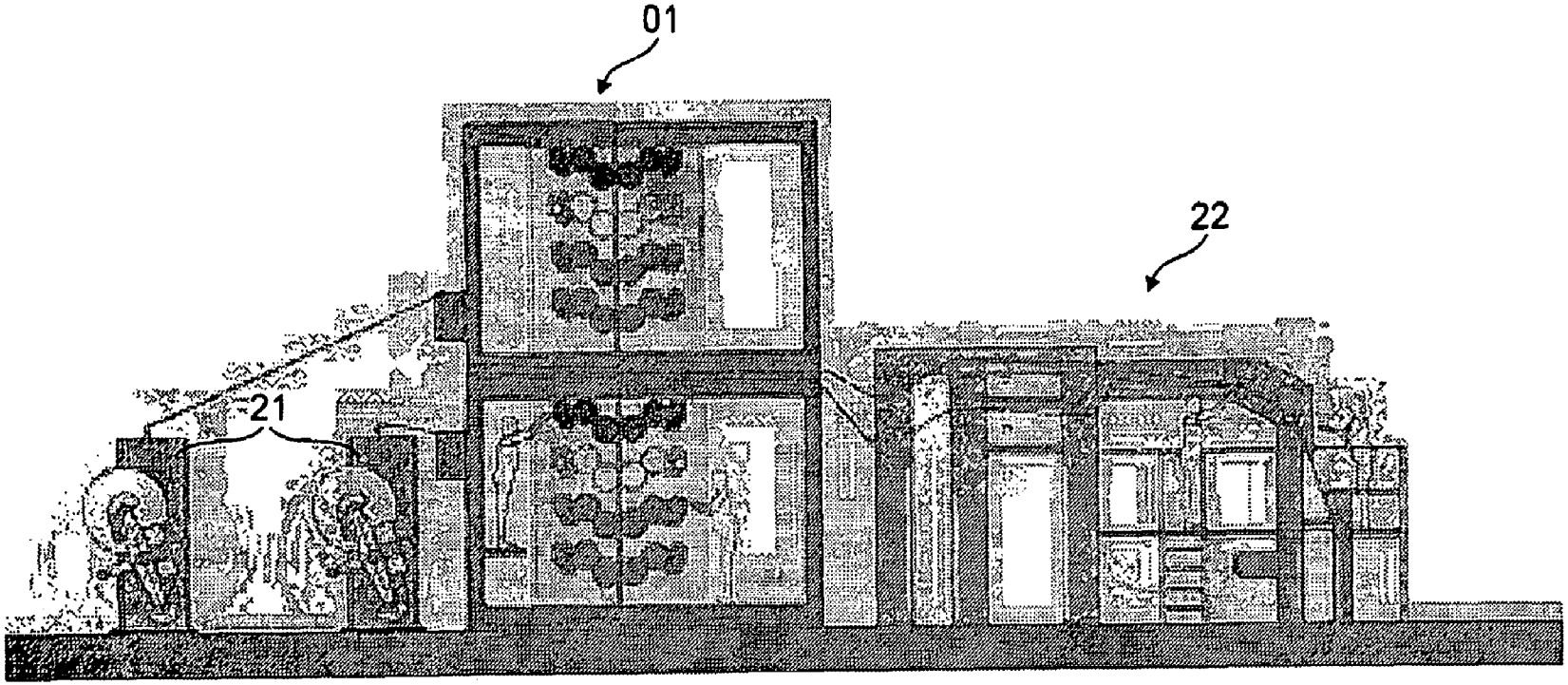
FIG. 2 a simplified illustration of a web-fed offset printing machine from a side view.

If the printing machine is designed as a web-fed printing machine, as illustrated by way of example in FIG. 2 and known in its basic construction to one of ordinary skill in the art, the printing substrate is preferably fed from one or more reel splicers 21 to one or more printing couples 01, wherein the printing couples 01 can be stacked one on top of another to form a printing tower. Accordingly, the printing substrate is guided vertically through the printing couple or couples 01. Once it has passed through the printing couples 01, the printing substrate is preferably fed to a folding unit 22 that is allocated to the web-fed printing machine or to at least a portion of its printing couples 01, wherein the folding unit 22 can be designed as a cross folding unit 22 and/or as a lengthwise folding unit 22.

Depending upon the type of printing machine that is used, the printing substrate is material in the form of sheets or a web, each preferably consisting of a material produced from comminuted plant fibers, and, depending upon its use and its surface weight, can be classified as the product type paper (<150 g/m$^2$), paperboard (150 to 600 g/m$^2$) or heavyweight board (>600 g/m$^2$). The size of a sheet can be, for example, more than 1,000 mm lengthwise relative to its direction of transport through the printing machine and, for example, more than 700 mm crosswise relative to its direction of transport through the printing machine. A web of material can also have a width, for example, of more than 1,000 mm lengthwise relative to its direction of transport through the printing machine.

To improve the printability of the printing substrate, a printing substrate especially comprised of paper can be coated on its surface on one side or both sides, in other words it can be provided with a white, single-layer or multi-layer applied quantity of coating comprised of pigments, binding agents and additives, such as optical brightening agents, whereby the surface of the printing substrate is purposely influenced in terms of its brightness, its hue and/or its production-based structure or coarseness. In this, the surface weight of the quantity of coating ranges, for example, from 5 to 20 g/m$^2$, preferably from 5 g/m$^2$ to 10 g/m$^2$. Also, after the surface of the printing substrate has been coated, its polishing, in other words a smoothing of the surface of the printing substrate in a calender, can take place, which in turn also affects the optical properties of the printing substrate and its printability. The surface of the printing substrate can also have an impressed or embossed structure, for example for use as banknote paper or document paper, wherein this structure can be designed as a surface structure or as a relief.

When the printing substrate passes through the printing machine, the influence on it by moisture from the air surrounding it, from an ink that is applied to its surface, from a dampening agent that is supplied to the printing process, or by an onslaught of mechanical forces is unavoidable. Depending upon its physical characteristics, these factors differently affect a stretching of its surface crosswise and/or lengthwise in its direction of transport through the printing machine, wherein these can be classified as moisture expansion and/or mechanical expansion depending upon the cause. These effects manifested on the printing substrate affect its runability.

In most cases, multiple inks are involved in a printing, which, once multiple color patches have been overprinted in a halftone color-mixing process, complement one another to form a multicolor printed image, wherein each color patch prints only one of the inks being used in the printing onto the printing substrate. Frequently, inks in the color hues magenta, cyan and yellow are used as the primary inks, from which a multitude of additional hues can be mixed. In most cases, in order to reduce the industrial expense of generating black or a gray tone as a mixture of the three aforementioned chromatic colors, thereby saving on costly chromatic inks, additional ink in the black hue is also used. Furthermore, one or more special colors can be printed, in order to create a client-specific hue or effect in the printing. In this, the colorimetric properties of the inks used in the printing, in combination with the physical characteristics of the printing substrate on which the inks are applied in the printing machine, substantially affect the range of color that can be reproduced in the printing. The colorimetric properties of the printing inks are also dependent, among other factors, upon the chemical composition of their color pigments. In most cases comparatively costly ink pigments can, for example, expand the range of colors that can be reproduced using said printing ink. In addition, for example the color contrast that can be produced using a given ink is dependent upon the printing substrate that is used. With coated papers, in the overprinting of the primary inks for the full tone, an optical density of approximately two density units can be achieved.

In the halftone color-mixing process, the multicolor printed image is created in a printing technique that uses color patches, each of which contains halftone dots. For each of the inks being used in the printing, one color patch is provided and the halftone dots of different color patches are applied to the printing substrate both independently adjacent to one another and on top of one another. The quality of the printing is influenced by the nature and the gauge of the rasterization, in other words the surface formation and arrangement of the halftone dots. In an offset printing process, halftone dots can typically be reliably transferred from a size of approximately 10 mm, wherein in multicolor printing, halftone frequencies of between 50 and 80 lines per cm are customary. Fine rasters for reproducing filigran structures have up to 150 lines per cm, since the finer the rasterization, the higher the resolution capability of the printing and thus the reproducibility of fine structures. In order to avoid moiré in multicolor printing, i.e. an interference phenomenon or a rosette formation, it is recommended that the rasterization be non-periodic. By combining periodic and non-periodic rasterization, the quality of the printing can be further increased. With a proper screen angle of the color patches involved in the printing at angular distances of, for example, 15°, moiré can be largely prevented.

Halftone dots can, for example, be circular, square, or elliptical in shape, and can be arranged in an amplitude-modulated, a frequency-modulated, or an intensity-modulated rasterization. In amplitude-modulated rasterization, the individual halftone dots have constant center point spacing and vary in their surface expansion, whereas in frequency-modulated rasterization, the individual halftone dots have a constant surface expansion with varying center point spacings. In intensity-modulated rasterization, the coating thickness of the halftone dots that are applied to the printing substrate is varied, thus changing the optical density of the halftone dots. Mixed forms of rasterization with a multidimensional modulation are possible. In multicolor printing, the positioning of the halftone dots of different color patches involved in the printing relative to one another, and the degree of surface distribution of the halftone dots in each of these color patches in the overprinting of the halftone dots, influences the quality of the printing. In the overprinting, the positioning of the color patches relative to one another is referred to as the color register or as the color-to-color register.

The physical characteristics of the inks used in the printing have a sustained effect on the quality of the printing. These physical characteristics of the ink include its rheological behavior, in other words its flow characteristics and its adhesive properties on the printing substrate and on halftone dots of at least one previously printed color patch. The flow characteristics of the ink are determined by its viscosity. The more viscous an ink is, the more sluggish it is, the result of which is that it runs more poorly and is slower to spread into a homogeneous film. The adhesive capability of the ink is specified by its tack. The higher the tack of the ink is, indicated in the form of a tack value, the less capable it is of splitting. As a result, greater amounts of force are required to transport a film of this ink through an arrangement of rotational bodies, and to transfer it onto the printing substrate, which in the printing machine, due to higher frictional resistance, leads to the generation of heat.

The viscosity and tack of a printing ink are dependent upon temperature. A production speed of the printing machine, at which the printing substrate is transported through the printing machine and which in a sheet-fed printing machine can amount, for example, to 18,000 sheets/hour, or in a web-fed printing machine, for example, can amount to 16 m/s, at least indirectly affects the viscosity and tack of the ink. In the overprinting of multiple inks, in order for a subsequently printed ink to adhere to a previously printed ink, the subsequent ink must have a lower tack value ("trapping").

The printing machine shown in the examples of FIGS. 1 and 2 has at least one machine element 08 that can be adjusted with a setting element 07, wherein an adjustment of the at least one machine element 08 influences the quality of the printing performed by the printing machine as a controlled process 09, in other words a process that is to be controlled. A detection device 11, preferably an optical detection device 11, with a sensor that is directed toward a surface of a printing substrate printed in the printing machine, detects the quality of the printing. A control device 12 that receives data from the optical detection device 11 uses the setting element 07 to adjust the at least one machine element 08 on the basis of a difference between a quality of the printing that is preset as the target value and the quality of the printing that is detected by the optical detection device 11 as the actual value, in a manner that serves to minimize the difference between the target value and the actual value, preferably after a permissible tolerance limit is reached or exceeded.

The at least one machine element 08 that can be adjusted with respect to the quality of the printing is, for example, a temperature-control device for controlling the temperature of at least a part of a circumferential surface of a rotational body of the printing machine, wherein the rotational body is involved in the transport of a printing ink onto the printing substrate that is printed with the ink in the printing machine. In this, the temperature-control device can accomplish the temperature control using a gaseous and/or a liquid temperature-control medium. In other words the temperature control can be accomplished, for example, with air or with water, wherein the temperature-control medium flows, for example, through channels in the rotational body that are near the circumferential surface. The temperature-control device ensures that the printing ink to be transferred, among other things, to a forme cylinder arranged in the printing couple 01 and then in a further transfer path to the printing substrate, maintains its temperature, for example, within a range of between 20° C. and 40° C.

The temperature-control device influences at least one rheological property of the ink, wherein the rheological property of the ink is preferably its viscosity or its tack. The temperature-control device holds the viscosity of the ink constant, within a temperature range relating to the air surrounding the printing machine of, for example, 20° C. to 40° C., at a value that preferably lies within a range of between 1 and 150 Pa*s, especially at a value that lies between 10 pa*s and 100 Pa*s. Within the temperature range of between 20° C. and 40° C., the temperature-control device preferably holds the tack of the ink to a tack value of between 6 and 9.5, especially to a tack value ranging from 7 to 8.5, and within the respective range of tack values preferably to a nearly constant tack value.

The temperature-control device can be adjusted in such a way that, alternatively or in addition to its adjustment within the temperature range of between 20° C. and 40° C., it holds the tack of the ink to a tack value within the range of 4 to 12 for a production speed of the printing machine of 3 m/s to 16 m/s. Preferably, the temperature-control device holds the tack of the ink to a nearly constant tack value for a production speed of the printing machine of 3 m/s to 16 m/s.

When multiple printing inks are being printed on the same printing substrate, the temperature-control device preferably adjusts the tack value of the printed inks differently. In this, the inks that are printed by at least two printing couples onto the same printing substrate have tack values that differ from one another. In order to achieve good adhesive capability in the overprinting of inks, the temperature-control device is preferably adjusted such that when multiple inks are being printed onto the same printing substrate, the tack value of the printed inks is preferably continuously decreased from the first to the lasted printed ink. For this purpose it is advantageous for each printing couple 01 to have at least one temperature-control device for controlling the temperature of at least one part of the circumferential surface of at least one rotational body of the printing couple 01, and additionally for each temperature-control device to be adjustable independently of another temperature-control device in the same or in a different printing couple 01. In the preferred embodiment, the temperature-controlled rotational body is designed as a forme cylinder 08 in a printing couple 01 or as an anilox roller in an inking unit 13 that applies ink to the forme cylinder 08.

A further machine element 08 can be designed as a metering device in the inking unit 13 for metering the quantity of printing ink to be transferred onto the printing substrate. This metering device can have multiple, for example between 30 and 60, zones in an axial direction of the forme cylinder 08, wherein the metering of the ink to be transferred onto the printing substrate can be adjusted differently in different zones. The metering device can, for example, have controllable ink zone keys, wherein in printing machines used in multicolor printing a total of several hundred separately controllable ink zone keys can be provided. The metering device meters a quantity of the ink to be transferred onto the printing substrate via an adjustment of its coating thickness and/or the duration of its application. Thus the metering device can also be designed as an ink supply system that utilizes at least one ink pump, for example as an ink injector system, wherein ink is supplied to an ink fountain roller of an inking unit, and can be metered at the ink fountain roller, preferably in zones, by means of individual setting [correcting] elements that act upon the different color zones. The setting elements are equipped, for example, with an ink metering element, for example at least one ink blade or one ink lever, that can be actuated via at least one electrically actuatable servo drive, wherein the servo drive is designed, for example, as a servo motor that can be controlled via a control unit. The inking unit can be designed as a roller inking unit or as an anilox inking unit. As an alternative, the inking unit can also be designed as a spray inking unit that atomizes ink, and preferably applies the ink in zones on an ink fountain roller.

In an offset printing machine, at least one forme cylinder 08 and one transfer cylinder 14 that operates in conjunction with said forme cylinder 08 are provided. It is advantageous for the forme cylinder 08 and the transfer cylinder 14 to each have as their setting element 07 preferably a drive unit that can be controlled independently of the others, for example electrically, and is preferably position controlled. Accordingly, the printing machine is preferably designed to be shaftless, wherein the drives for the forme cylinder 08 and/or the transfer cylinder 14 are mechanically separated from a drive of an allocated impression cylinder 16, and the drives rotationally power the cylinders 08; 14; 16 during the printing. Although it can be provided that the forme cylinder 08 and the transfer cylinder 14 are mechanically coupled, for example via toothed gears, and have a common controllable, position-controlled drive, this common drive is mechanically separate in any case from a drive of the impression cylinder 16. With at least one of the controllable drives, a phase position or an angular position of the forme cylinder 08 and/or the transfer cylinder 14 relative to the impression cylinder 16, or relative to another forme cylinder 08 of the printing machine, can be adjusted and preferably regulated, wherein the phase position or angular position can be used to adjust a circumferential register. However, even if the forme cylinder 08 is positively coupled to the impression cylinder 14, a servo drive can be provided for phase adjustment. The circumferential register affects the positioning precision of a color patch relative to a reference edge or reference line of the printing substrate that is oriented crosswise to the direction of transport of the printing substrate.

The printing substrate is passed between the impression cylinder 16 and a transfer cylinder 14 that operates in conjunction with the impression cylinder 16. Furthermore, each printing couple 01 of the printing machine illustrated by way of example in FIG. 1 has an inking unit 13 that operates in conjunction with the forme cylinder 08 and a dampening unit 17, wherein the printing inks that are printed by at least two printing couples 01 onto the same printing substrate preferably have hues that are different from one another.

A further setting element 07 provided in the printing machine can be a servo mechanism for adjusting a contact pressure, wherein a roller of the inking unit 13 or a roller of the dampening unit 17, which transfers a dampening agent to the forme cylinder 08, exerts the contact pressure on the forme cylinder 08 or on some other roller of the inking unit 13 or the dampening unit 17. This servo mechanism can be designed, for example, as a remotely-actuatable roller socket, in which the ends of the roller of the inking unit 13 or the dampening unit 17 are seated, wherein the roller socket adjusts the contact pressure exerted by a roller, the width of a roller strip, or a gap width between the circumferential surfaces of two coordinating rollers, by means of actuators arranged in said roller socket. Preferably at least two rollers of the inking unit 13 or the dampening unit 17 each have a drive that can be controlled independently of the others, wherein a further setting element 07 of the printing machine is, for example, a control device, which controls a relative speed between the independently actuated rollers. The control device especially adjusts the relative speed between the rollers of the dampening unit 17 for metering the quantity of dampening agent being transferred to the forme cylinder 08, based upon the quantity of the quantity of ink being transferred by the inking unit 13 onto the forme cylinder 08.

It is advantageous for the printing machine to have as an additional setting element 07 a servo drive for adjusting the inclination of a forme cylinder 08 arranged in the printing machine, relative to the printing substrate. In this manner, the so-called "cocking" effect can be compensated for when a printed image is arranged at an angle on a printing forme and/or a printing forme is arranged at an angle on a forme cylinder 08 relative to the axial direction of the forme cylinder 08. For example, at least one axial end of the forme cylinder 08 is seated in an eccentrically adjustable bearing, wherein the servo drive, in order to place the forme cylinder 08 in an inclined position, eccentrically adjusts its seating in the at least one eccentrically adjustable bearing relative to the seating in the bearing in which the other end of the forme cylinder 08 is seated. At least one bearing of the forme cylinder 08 is designed, for example, as an eccentric bushing. If the inclination of the forme cylinder 08 is accomplished by pivoting the forme cylinder 08 not around one of its pivot points, but rather around a pivoting point arranged between the two pivot points, then to adjust the inclination of the forme cylinder 08, the servo drive adjusts said cylinder in a centrosymmetrical fashion relative to an axis that is oriented vertically on the surface of the printing substrate.

Another setting element 07 of the printing machine can be a servo mechanism for axially shifting the forme cylinder 08. Furthermore, a servo mechanism for the axial shifting of at least one printing forme arranged on the forme cylinder 08 can also serve as a setting element 07. The servo mechanism designed for the axial shifting of at least one printing forme arranged on the forme cylinder 08 shifts said forme, for example, relative to at least one other printing forme arranged on the same forme cylinder 08. The servo mechanism for the axial shifting of the forme cylinder 08 or the servo mechanism for the axial shifting of at least one printing forme arranged on the forme cylinder 08 can also shift the printing forme arranged on the forme cylinder 08 relative to a printing forme on another forme cylinder 08 arranged in the same printing machine. The servo mechanism for the axial shifting of the forme cylinder 08 or the servo mechanism for the axial shifting of at least one printing forme arranged on the forme cylinder 08 can be used to adjust a lateral register and/or also for an at least partial compensation of a moisture-based lateral strain on the printing substrate during its transport through the printing machine, in other words to compensate for fan-out. The lateral register affects the positioning precision of a color patch relative to a reference edge or reference line of the printing substrate that is oriented in the direction of transport of the printing substrate.

Especially to compensate for fan-out, an image corrector that compensates at least partially for a lateral strain on the printing substrate can be provided as a further machine element 08, wherein the image corrector has reels or blowing nozzles that act on the surface of the printing substrate, and is arranged between two printing couples 01 in the direction of transport of the printing substrate, preferably close in front of the printing couple 01 that subsequently prints onto the printing substrate.

To detect the quality of the printing, an optical detection device 11 with a sensor that is directed toward the surface of the printing substrate printed on in the printing machine is provided. The optical detection device 11 is preferably designed as an inspection system, especially as an inline inspection system that inspects the printing substrate during its transport through the printing machine. An inspection system expands the functionality of an optical detection device 11 to the extent that [, alternatively or especially in addition to the detection of the, for example, densitometrically identifiable optical density of a printing ink applied to the printing substrate, of the hue, which can be determined calorimetrically, especially using a spectrophotometer, of the color register taken from color patches relative to one another, or of the circumferential register and/or the lateral register of a color patch,] possible imperfections in the printing, caused, for example, by the transport of the printing substrate or by the printing process, can also be recognized, and suitable measures for eliminating the imperfection or for diverting the faulty printed product can be initiated. Imperfections identified by an inspection system include, for example, scratches, kinks, particles of paper or dirt, ink residue or hickeys. The detection of the imperfections can be alternatively to or especially in addition to the detection of the, for example, densitometrically identifiable optical density of a printing ink applied to the printing substrate, the hue, which can be determined colorimetrically, especially using a spectrophotometer, the color register taken from color patches relative to one another, or the circumferential register and/or the lateral register of a color patch.

As its basic function, the optical detection device 11 detects, without contact, the acceptance of at least one printing ink being used in the printing on the printing substrate printed in the printing machine. If at least one ink used in the printing is present on the printing substrate printed in the printing machine at the point of detection of the optical detection device 11, the optical detection device 11 identifies the presence of the ink in at least one physical characteristic of said ink.

The physical characteristic of the ink can be its colorimetric hue, an optical density or a coating thickness, a form, a position, an angle or a surface distribution of its halftone dots applied to the printing substrate. The optical detection device 11 can also detect, for example, a position of at least one halftone dot of one ink being used in the printing relative to a position of at least one halftone dot of at least one other ink being used in the printing, or a position of at least one halftone dot of an ink being used in the printing in a printed image printed onto the printing substrate, wherein the former detection option is a relative measurement and the latter detection option is an absolute measurement, i.e. a determination of coordinates of the halftone dots in reference to the printed image to be printed.

Especially if the printing machine prints on both sides of the printing substrate, i.e. if it functions as a sheet-fed printing machine in straight and perfecting printing, the optical detection device 11 can detect printed images printed on opposite sides of the same printing substrate and their position relative to one another, in other words a so-called turning register. It is understood that the printed image that is printed on the printing substrate is preferably comprised of multiple color patches.

It can be provided that the optical detection device 11 detects a physical characteristic of the printing substrate that is printed on in the printing machine. The physical characteristic of the printing substrate is especially a property that affects its printability or its runability. Thus the physical characteristic of the printing substrate can be a wet stretching and/or a mechanical stretching of its surface crosswise and/or lengthwise in its direction of transport passing through the printing machine. The physical characteristic of the printing substrate can also be a quantity of coating that is applied to the surface of the printing substrate, especially a quantity of coating applied to the surface of the printing substrate having a coating weight of more than 5 g/m$^2$. The physical characteristic of the printing substrate can also relate to a degree of brightness of its surface.

The optical detection device 11 detects, for example, at least one mark that is assigned to a color patch. Preferably the optical detection device 11 detects two marks simultaneously, which are allocated to one color patch and are spaced from one another crosswise to the direction of transport of the printing substrate, in order, for example, to identify an interfering factor resulting from fan-out. It is advantageous for said mark to be designed as a micro-mark having a width of at most 0.2 mm, in other words in a spread that is below the resolution capability of the human eye.

Alternatively or in addition, to detect at least one mark, the optical detection device 11 can detect at least one measurement field that is assigned to one color patch, wherein the measurement field is, for example, a section of a color patch and contains halftone dots of at least one ink. The measurement field can also be designed as a measurement strip preferably arranged outside of a type area of the printed image. The optical detection device 11 can, for example, simultaneously detect a position of two measurement fields allocated to one color patch that are incongruent crosswise to the direction of transport of the printing substrate, in order to identify, for example, an interfering factor caused by fan-out from the position of the measurement fields relative to one another.

With the mark that is detected by the optical detection device 11 or the measurement field detected by the optical detection device 11, a position of one color patch relative to another color patch and/or relative to a reference line of the printing substrate can be identified by means of an evaluation of data that correlate to the detection, wherein the reference line of the printing substrate is, for example, its lateral edge that is oriented lengthwise to its direction of transport. With an identification of the position of at least one color patch that has been printed onto the surface of the printing substrate relative to at least one reference line of the printing substrate, for example a centering of the printing substrate is possible, or at least one position occupied by the printing substrate relative to the printing machine, for example to its frame, can be determined. The centering is achieved, for example, in that the control device 12 controls at least one guide element arranged in the printing machine for the purpose of guiding the printing substrate during its transport through the printing machine, on the basis of the data provided by the optical detection device 11, or it transmits at least one signal to the control device that controls this guide element. On the other hand, the guide element designed for centering the printing substrate can also be included in the control of the quality of the printing as an additional machine element 08 that is controlled by the control device 12 via a setting element 07. In the preferred embodiment, multiple guide elements are provided for centering the printing substrate, each of which can be controlled by the control device 12 via a setting element 07.

The optical detection device 11 can especially be designed to employ an optical device, for example a lens, such that it scans at least the entire width of a color patch that extends crosswise to the direction of transport, preferably even a width of the printing substrate extending crosswise to the direction of transport.

The optical detection device 11 is preferably arranged behind the last printing couple 01 in the direction of transport of the printing substrate. In a sheet-fed printing machine that operates in straight and perfecting printing, the optical detection device 11 is arranged in front of a device for turning the printing substrate.

The sensor of the optical detection device 11 is preferably designed as an image sensor. The optical detection device 11 can have multiple sensors, even multiple image sensors. The sensor is designed, for example, as a photodiode, the image sensor, for example, as a CCD chip or as a CMOS chip. The sensor preferably senses multiple hues, especially simultaneously. The optical detection device 11 has, for example, a line camera or a surface camera.

An illumination device 18 is preferably provided for the optical detection device 11. The illumination device 18 can emit its light continuously or in pulses and can be designed, for example, as a cold light source, i.e. as a light source having only a very low infrared portion, or for practical purposes no infrared portion, in its light. Multiple light-emitting diodes or laser diodes, for example, are used as light sources in the illumination device 18. It is advantageous to provide a cooling device in the illumination device 18 especially for its light source. The cooling device can cool the light source using a gaseous or liquid coolant. For a simpler adaptation to a width of the measurement field, of the color patch or of the printing substrate to be scanned, said width being oriented crosswise to the direction of transport of the printing substrate, the illumination device 18 can be comprised of multiple modules that can be arranged in rows.

The illumination device 18 is preferably arranged near the cylinder that transfers ink onto the printing substrate, for example the transfer cylinder 14, or near the impression cylinder 16. In a sheet-fed printing machine the illumination device 18 is arranged, for example, underneath a pedal mechanism behind the last printing couple of the printing machine. The illumination device 18 is spaced somewhat from the surface of the printed substrate, with said spacing measuring, for example, between 30 mm and 200 mm, preferably between 80 mm and 140 mm, whereas the spacing between the sensor of the optical detection device 11 and the printing substrate measures between 10 mm and 1,000 mm, preferably between 50 mm and 400 mm. The distance between the illumination device 18 and the surface of the printed printing substrate is chosen such that on one hand an even, intense illumination of the surface of the printing substrate occurs, while on the other hand a contamination of the illumination device 18 by particles of dirt stirred up during the transport of the printing substrate, or by a cloud of ink spray, is largely prevented.

The optical detection device 11 provides data that correspond to the detection of its sensor, for example digital image data, at its output, said data being received by a control device 12 that is connected to the optical detection device 11. To compensate for a systematically occurring difference between the target value and the actual value, the optical detection device 11 can preferably also transmit a signal s, preferably via the control device 12, to an imaging device for imaging a printing forme that prints a color patch.

The control device 12 can also control a marking device designed to identify the printing substrate, based upon the data provided by the optical detection device 11, wherein said marking device is designed, for example, as an inkjet printer, as a printing device that prints using a typographic printing process, or as a notching device, or is equipped with a laser. If the marking device is designed as a printing device that prints using a typographic printing process, it employs, for example, a process similar to letterpress printing or a letterset process, similar to that used in a numbering unit. Furthermore, especially if the printing machine is designed as a sheet-fed printing machine, the control device 12 can control a switch for changing the transport pathway of the printing substrate, based upon the data provided by the optical detection device 11, wherein the switch, which can also be characterized as a wasted paper switch, feeds a printed product found by the control device 12 to be of good quality to a first delivery unit, and feeds a printed product found to be of poor quality, for example, to a second delivery unit.

If the printing machine is designed as a web-fed printing machine, it can further be provided that the optical detection device 11 again transmits a signal s, preferably via the control device 12, to a control device for controlling a folding unit 22 arranged downstream from the printing couples 01, wherein said signal s is used especially to control a cutting cylinder on the folding unit 22, designed to cut off or perforate a web of material that has been printed with the printing couples 01 of the printing machine, crosswise to its direction of transport, based upon the position of the printed image. The cutting device or perforation device can be designed as a cutting cylinder arranged in the folding unit 22, wherein the control device 12 controls or regulates a phase position or angular position of the cutting cylinder relative to the position of the printed image identified by the optical detection device 11. The control device 12 then controls or regulates the so-called cut-off register.

It can also be provided for a cutting device or a perforation device to be arranged at a position that can be varied crosswise to the direction of transport of the web of material, based upon the position of the printed image identified by the optical detection device 11, for the purpose of performing a cut oriented lengthwise relative to the direction of transport of the web of material, wherein this cutting device that cuts the printing substrate lengthwise or this perforation device that perforates the printing substrate lengthwise is arranged, for example, in front of the intake point of the printing substrate into the folding unit 22, or inside said unit. In this manner, the entire trimming of the printing substrate can be performed in each case based upon the position of the printed image identified by the optical detection device 11. The position of the printed image can be identified and/or monitored relative to a reference edge or reference line of the printing substrate, or relative to a reference point fixed on the machine, for example to the center of the printing cylinder or to a frame of the printing machine that extends laterally relative to the printing substrate. The optical detection device 11 can be arranged, for example, at a guide roller in front of a cross fold unit 22 and/or in front of a longitudinal fold former.

If the printing substrate, for example a paper web, has multiple partial webs running adjacent to one another, crosswise relative to its direction of transport, the control device 12 can also control or regulate the cut-off register in that the web length of at least one of the partial webs is controlled or regulated based upon the position of the printed image identified by the optical detection device 11, in that one or more register rollers, each of which guides one of the partial webs, are changed in their respective position by the signal s transmitted by the control device 12, whereby the respective web length of at least one of the partial webs relative to another partial web is changed, wherein the correlative partial webs are fed to the same cutting device or perforation device, for example in the folding unit 22. The difference between a cut-off position given by the target value and a position of the printed image identified by the optical detection device 11 defines a cut-off position deviation, which can be determined, for example, in that a first profile, for example a brightness profile of the digital printed image content, is prepared from the printed image in the direction of transport of the printing substrate known from the prepress. This profile is compared with a similar second profile prepared in the printing process from the relevant detected printed image, in other words, for example, with another brightness profile from its digital printed image content, wherein a misalignment between the two profiles correlates with the deviation in cut-off position. The identified deviation in cut-off position is then used to control or regulate the cutting device or perforation device.

If multiple webs or partial webs of the printing substrate that have been printed with an image are assembled and stacked before reaching the cutting device or perforation device, which is arranged, for example, in the folding unit 22, they form a ribbon. The control device 12 can also be employed to control or regulate a so-called ribbon register, in that, for example, the phase position or the angular position between the forme cylinder 08 and/or transfer cylinder 14 that are involved in the printing of the individual webs or partial webs of the ribbon relative to one another changes, so that the position of the printed images printed on the individual webs or partial webs of the ribbon relative to one another changes. The individual webs or partial webs of the ribbon, each of which is printed with an image, are then assembled and stacked in such a way that if they are cut or perforated together by a cutting or perforation of the ribbon, the printed images on the respective webs or partial webs come to lie in the correct position on top of one another, and none of the printed images are damaged in the cutting or perforation as a result of a deviation in cut-off position.

Furthermore, in a web-fed printing machine it can be provided that, again preferably via a signal s from the control device 12, for example based upon the position of the printed image identified by the optical detection device 11, a web intercept device or a web severing device is actuated or the printing machine is shut down if the control device 12 detects a paper web break or some other serious malfunction in the production being implemented with the printing machine, based upon a significant deviation in the relevant scanned printed image from its expected position. The web intercept device can have at least one intercept roller. The web severing device is equipped, for example, with a cut-off blade. The significant deviation in the position of the printed image can consist in exceeding a preset threshold value. The control device 12 can also transmit a signal s to a control device when the control device 12 identifies a hole in the printing substrate from the data from the optical detection device 11.

When a difference between the target value and the actual value is identified, the control device 12 further determines, for example, a change in spacing between two marks or measurement fields that are arranged crosswise to the direction of transport of the printing substrate and are incongruent in their spacing or at least in their respective positions. The optical detection device 11 preferably simultaneously detects the two marks or measurement fields that are assigned to the same color patch, and the control device 12, based upon the detected change in the spacing, uses the setting element 07 to adjust the at least one machine element 08. In this manner an interfering factor caused by fan-out, i.e. by a change in the width of the printing substrate occurring during the printing process, can be counteracted.

If the printing machine has a dryer through which the printing substrate passes after the ink has been applied, the detection device 11 can be arranged, for example, downstream from a dryer, i.e. at its outlet.

It is advantageous for the control device 12 to implement the process of adjusting the at least one machine element 08 continuously during printing, wherein the control operation preferably takes place when a permissible tolerance limit is especially repeatedly reached or exceeded by relevant detected actual values. The permissible tolerance limit can allow, for example, deviations of 10% from the target value.

The permissible tolerance limit can also be defined, for example, as a position deviation of the halftone dots of less than 10 mm, as a color measurement error of $DE^3 3$, or as an error precision in the optical density of DD>0.02, wherein this last tolerance value is oriented toward those tonal value fluctuations that can typically still be perceived by the human eye. For practical purposes, slighter tonal value fluctuations are no longer perceived by the human eye as uneven ink applications, and thus require no control intervention by the control device 12.

The target value for the quality of the printing, which is provided to the control device 12 as a reference value, is, for example, data taken from a prepress performed prior to the printing or from a reference substrate transported through the printing machine prior to the printing. Alternatively or in addition, the target value for the quality of the printing can be input into the control device 12 prior to the printing using at least one input element, so that the control device 12 can draw the target value from these input data. In this, the input of the data that establish the target value can be a recall of a selection from a quantity of data, in that the target value is selected from a quantity of standard values corresponding to the relevant application being run. It can also be provided that at least one actual value for printing substrate previously printed on in the printing machine forms the target value for printing substrate subsequently printed on in the printing machine.

Moreover, it can be provided that a mean value of multiple actual values for printing substrate previously printed on in the printing machine forms the target value for printing substrate subsequently printed on in the printing machine. In this respect, the control device 12 can be designed as an adaptive, self-learning system.

It is advantageous for the control device 12 to display the difference between the target value and the actual value on a display device, to emit an acoustic and/or and optical warning signal if there is a difference between the target value and the actual value, and/or to register and record the difference between the target value and the actual value. In this, the detection of the quality of the printing in its entirety by the optical detection device 11 facilitates a log that can preferably be created for all copies produced in the printing, which the party performing the printing can present as proof of quality to the party ordering the printing.

In one embodiment, in the event of a difference between the target value and the actual value, the control device 12 uses the setting element 07 to adjust the at least one machine element 08 in a manner that serves to minimize said difference only with a release from an operator. In another embodiment, in the event of a difference between the target value and the actual value, the control device 12 automatically uses the setting element 07 to adjust the at least one machine element 08 in a manner that serves to minimize said difference. It can be provided that the control device 12 uses the setting element 07 to adjust the at least one machine element 08 only when the difference between the target value and the actual value reaches or exceeds a preset threshold value. Advantageously, the control device 12 is integrated into a control center that is a component of the printing machine.

The setting element 07 that adjusts the at least one machine element 08 is designed, for example, as an electric, as a hydraulic, or as a pneumatic drive, wherein said setting element 07 is actuated, for example, electrically. Preferably, for each adjustable machine element 08 a separate setting element 07 is provided, wherein the setting elements 07 for different machine elements 08 can be adjusted independently of one another via the control device 12.

It is advantageous for at least the optical detection device 11, the control device 12 and at least one of the setting elements 07 to be connected to a common data bus.

Thus the above-described printing machine has, for example, cylinders, rollers, a temperature-control device, a metering device for an inking unit 13 and/or an image corrector as a machine element 08 that can be adjusted with respect to the quality of the printing. As setting elements 07, for example, individual actuators for the cylinders and/or rollers, a servo mechanism for an inclination of the cylinder, a servo mechanism for adjusting a degree of contact pressure exerted between the rollers and/or a control device for controlling a relative speed existing between rollers are provided. The adjustment of each of these machine elements 08 performed via the respective allocated setting element 07 directly influences the quality of the printing in a perceptible manner, wherein the optical detection device 11 detects the quality of the relevant printing produced by the printing machine via a sensor, preferably continuously or at least in rapid sequence, and supplies data that correlate to the quality of the printing to the control device 12. The control device 12 in turn uses at least one setting element 07 to adjust at least one of the machine elements 08 based upon a difference between a quality of the printing that has been preset as a target value and the quality of the printing identified by the optical detection device as the actual value, in a manner that serves to minimize this difference between the target value and the actual value. Accordingly, a closed control loop results, as is schematically illustrated in a simplified functional block diagram in FIG. 3.

On one hand the machine elements 08 of the printing machine act on the position of halftone dots printed on the printing substrate, which can be determined via coordinates, specifically on the position of the halftone dots relative to a reference line on the printing substrate, wherein said reference line can be, for example, a lateral edge of the printing substrate, and/or on the position of halftone dots of a different ink, which cover these halftone dots relative to one another. On the other hand, the machine elements 08 of the printing machine influence the color stimulus of the printed inks, i.e. their physically measurable, colorimetric properties, both for an individual ink and in coordination with other inks involved in the composition of the same printed image. Properties of the printing substrate also influence the position of halftone dots printed on the substrate and their color stimulus, for which reason these should also advantageously be included in the control loop that regulates the quality of the printing.

To control the quality of the printing, a matrix of parameters that can be combined with one another results from the above-described influencing variables, wherein certain combinations of adjustments that influence the quality of the printing are particularly advantageous for adjusting the quality of the printing, for example in the final proof from the printing machine and, for stabilizing the quality of the printing at the adjusted level, especially in the print run on the printing machine. This is because they are particularly effective at counteracting, for example, wear and tear, thermal, or climatic interfering factors that occur during the printing and negatively affect the reproducibility of the quality of the printing and thereby the controlled process 09. Interfering factors resulting from wear and tear appear on machine elements involved in the printing, thermal interfering factors affect the runability of the involved inks, and climatic interfering factors, such as a temperature of the surrounding air and moisture, affect the runability of the printing substrate. All of these interfering factors, in any random, for the most part unforeseeable, combination and intensity, can affect the quality of the printing, i.e. can impair it, so that a continuous monitoring of the quality of the printing is advantageous. The temporal behavior of the individual interfering factors can vary greatly, ranging from slowly to rapidly changing or oscillating. Furthermore, the interfering factors can appear evenly or unevenly in the printing, thereby exhibiting a stochastic distribution.

Figure 3:
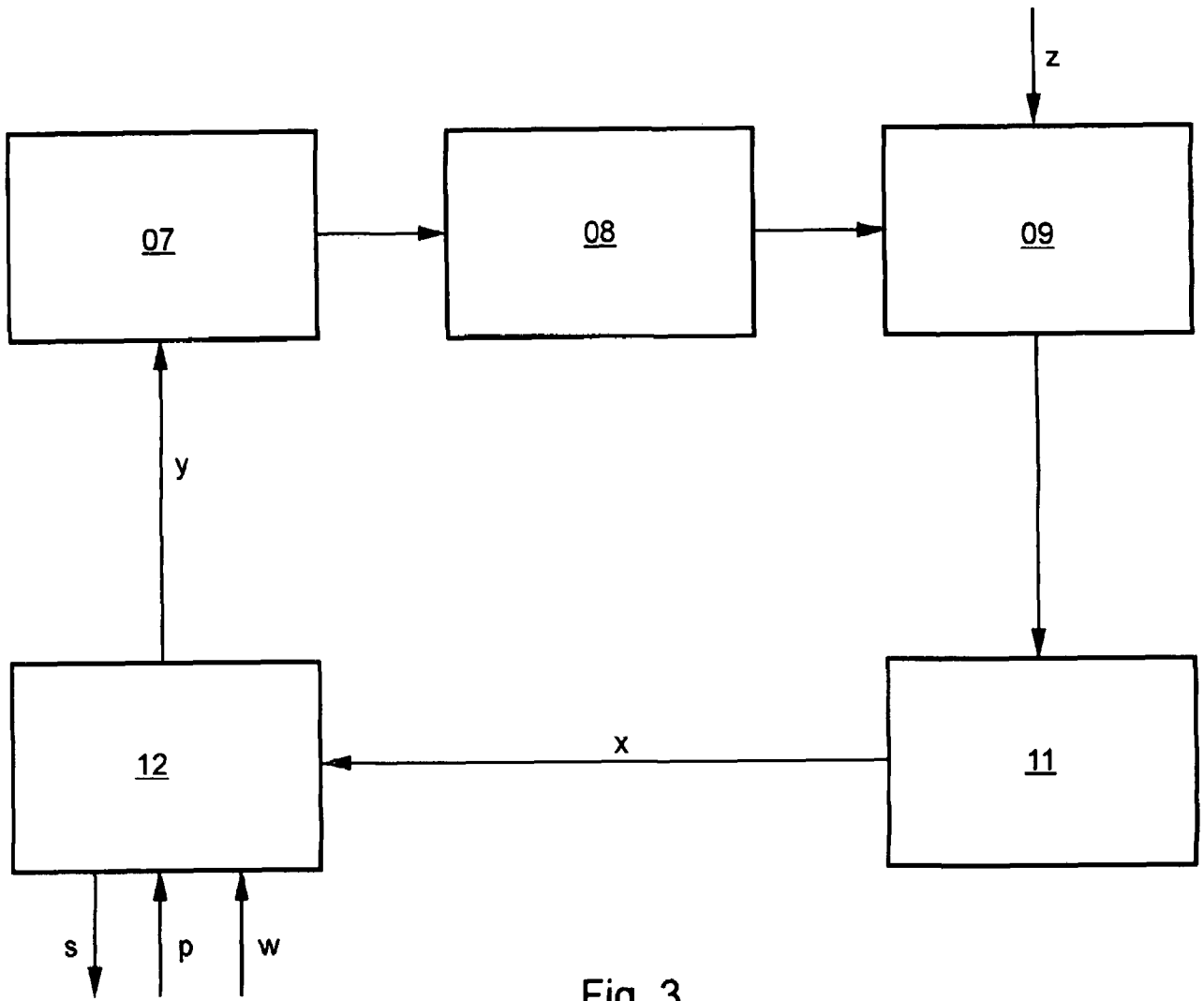
FIG. 3 a simplified functional block diagram of a control circuit that controls the quality of a print run.

All interfering factors that affect the controlled system 09 are indicated in FIG. 3 by the reference symbol z, regardless of their respective cause, their respective temporal behavior, or their surface effect on the printing. The data provided by the optical detection device 11, which correlate with the detected quality of the printing and form a control variable x for the control device 12, are identified together in FIG. 3 by the reference symbol x, regardless of their physical characteristics. The target value, which is supplied to the control device 12 as a reference input variable w, is indicated in FIG. 3 by the reference symbol w. The control device 12 acts with a signal y, indicated in FIG. 3 in summary by the reference symbol y, on at least one setting [correcting] element 07 of the control loop, however it can also especially transmit a further signal s, identified by the reference symbol s, to one or more additional control devices.

With respect to the combinations that affect the quality of the printing, and thereby the controlled system 09, it is advantageous, for example, to provide that the at least one machine element 08 is a temperature-control device for controlling the temperature of at least part of a circumferential surface of a rotational body in the printing machine, wherein said rotational body is involved in the transport of a printing ink onto the substrate printed with said ink in the printing machine, since the temperature-control device can influence the rheological properties of the ink.

In a further combination it is advantageous to provide that the setting [correcting] element 07 is a servo drive for adjusting an inclination of a forme cylinder 08 arranged in the printing machine relative to the printing substrate, as this will serve to counteract the "cocking" effect.

And in another combination it is advantageous to provide that when multiple inks are being printed onto the same printing substrate, the setting element 07 adjusts the tack values of the printed inks differently, in order to enable an overprinting of the inks being used in the printing with good adhesion capability.

In one combination it is advantageous to provide that, when a difference between the target value and the actual value is identified, the control device 12 will determine a change in the spacing between two marks or measurement fields, which are arranged crosswise to the direction of transport of the printing substrate and are incongruent in their spacing or at least in their respective position, wherein the optical detection device 11 detects the two marks or measurement fields simultaneously, the two marks being assigned to the same color patch, wherein the control device 12 uses the setting element 07 to adjust the at least one machine element 08 on the basis of the determined change in the spacing, in order, for example, to counteract fan-out and to at least partially compensate for its interfering influence.

It is also advantageous to provide, in one combination, that the machine element 08 is a metering device for an inking unit 13, designed to meter the quantity of printing ink to be transferred onto the printing substrate, in order to influence the quantity of ink to be transferred onto the printing substrate by adjusting its coating thickness and/or its duration of application. The coating thickness of the ink applied to the printing substrate measures, for example, between 1 mm and 3 mm.

It can also be provided that, in at least one of the printing couples 01, the ink guide rollers and cylinders, especially the rollers of the inking unit 13, are first adjusted in their position relative to one another, based upon the production speed of the printing machine, by a control device provided for this purpose via corresponding servo drives, and, starting from this speed-based positioning, are then regulated by the control device 12 on the basis of the relevant produced quality of the printing established using data from the optical detection device 11. The speed-based positioning of at least one of the ink guide rollers and cylinders in its position relative to another roller or to another cylinder thus represents a basic adjustment, which represents a starting level for a subsequent control based upon the relevant produced quality of the printing. The speed-based positioning of the ink guide rollers and cylinders in their positions relative to one another can be accomplished, for example, by means of roller sockets that are attached to the rollers and are preferably remotely actuatable, wherein the actuation of the roller sockets allocated to a roller causes the affected roller to lift radially, thereby altering the position of said roller relative to at least one other adjacent roller. If it can be ascertained from the data provided by the optical detection device 11 that the quantity of ink being guided by the rollers is not suitable for the quality of the printed product to be produced, then the control device 12 can again alter the position of one or more of the ink guide rollers or cylinders in the ongoing printing process, in other words it can reposition them in order to achieve good printing quality. To implement the positioning of these rollers or cylinders, one roller socket is preferably provided at each end of each of these rollers or cylinders, wherein each roller socket has at least one actuator, and preferably multiple actuators, wherein the preferably remotely actuatable actuators are designed, for example, as pressure chambers that can be pressurized with compressed air, and are arranged such that the allocated roller or the allocated cylinder can be adjusted in at least two directions. The roller socket can act externally upon one of the ends of the allocated roller or the allocated cylinder, however it can also be arranged in the interior of said roller or said cylinder, although in either case the actuation of its actuators causes the roller or the cylinder to lift radially.

If one or more of the printing couples 01 is designed as an imprinter, it can be provided that a signal p is sent to the control device 12 to inform the control device 12 as to which of the printing couples 01 are involved in the relevant printing process, and/or which printing couple 01 is removed from the relevant printing process. Based upon the signal p, the control device 12 can determine which machine element 08 allocated to one of the printing couples 01, for example which metering device for an inking unit 13 allocated to the printing couples 01 for the purpose of metering a quantity of printing ink to be transferred onto the printing substrate, can influence the relevant produced quality of the printing by an actuation of its setting element 07.

For example, if two printing couples 01, each designed as an imprinter, arranged in direct sequence in the direction of transport of the printing substrate, print using the same ink, for example black, but for different elements of the printed image, for example for a text and a graphic or for two texts containing different language, then the difference between the respective target value and the relevant actual value detected by the optical detection device 11 can be determined separately for the two printing couples 01, i.e. independently of one another, and can be evaluated in a manner that serves to minimize this difference, in that for each of the two printing couples 01 its optimal target value is used in the target/actual comparison. In this manner a machine element 08 situated downstream in the direction of transport of the substrate and influencing the relevant produced quality of the printing, for example a printing couple 01 that prints using a different ink, can be adjusted within a shorter time to a value that is favorable to printing quality, in that, for example, the phase position or the angular position between the forme cylinder 08 and/or the transfer cylinder 14 of the imprinter that is involved in the printing and a printing couple 01 that is downstream in the direction of transport of the printing substrate is adjusted in each case based upon the imprinter that is involved in the printing.

What is common among the above-described characterizing features that influence the quality of a printing, and to the combinations of said features, is that the optical detection device 11 uses a sensor to detect the relevant quality of the printing being produced with the printing machine, and supplies data that correlate to said printing quality to the control device 12, which in turn compares a detected actual value with a preset target value and newly adjusts or repositions the relevant setting of at least one machine element 08 such that the relevant produced quality of the printing approaches the target value and is maintained there to the greatest extent possible. The control device 12 thus examines the data from the optical detection device 11 with respect to the presence of an interfering factor and, if an interfering factor is present, analyzes the data with respect to its cause, its temporal behavior, and/or its surface effect on the printing. As a result of the analysis, the control device 12 transmits at least one signal y to a setting element 07, in order to counteract the interfering factor. Preferably all, but at least multiple, control operations required to achieve the relevant produced quality of the printing are initiated from the analysis of the same data provided by the optical detection device 11. The signal y can thus be highly complex in terms of data technology, and can act on a multitude of setting elements 07, which can also apply to the signal s for controlling a control device that is connected to the control device 12.

In one combination of machine elements 08 that influence the quality of the printing it is advantageous to provide elements that will counteract interfering factors having different causes as well as different temporal behavior or surface effects. In the preferred embodiment at least one machine element 08 that acts upon the mechanical technology and at least one machine element that acts upon the properties of the material being used in the printing, especially the ink, are provided, and can each preferably be placed in use independently of the other by the control device 12 via at least one setting element 07, based upon the necessity determined from the data recorded by the optical detection device 11.

Moreover, with the detection of the quality of the printing in its entirety by the optical detection device 11, the control device 12 can analyze the received data according to different criteria and can emit a signal y as a control operation in the controlled system 09 generated from the analysis, said signal inducing diverse setting elements 07 and/or machine elements 08 together, i.e. simultaneously or at least in coordination with one another, to actions which, in their combination, synergetically counteract the various factors disrupting the printing. In this, the control device 12 does not react singularly to interfering factors, rather it evaluates their influence on the printing in their overall effect. An undesired under or overreaction of individual setting elements 07 and/or machine elements 08 can thus be minimized.

The detection of the quality of the printing in its entirety by the optical detection device 11 does not necessarily mean that the optical detection device 11 fundamentally detects all the properties of the printing, rather it relates much more to those properties of the printing that the party performing the printing has promised to the party ordering the printing, and that thus should be monitored for compliance.

Because the quality of the printing is preferably detected by the optical detection device 11 near the point of its production, and multiple, preferably all, relevant interfering variables are determined from the simultaneously detected data, which are evaluated in real time, preferably continuously, a rapidly effective control is possible, so that with respect to the printing, after only a very short time a stable operating status with a good level of quality can be achieved, which, due to a short reaction time for the control device 12, results in low paper wastage in the start-up phase and which can be maintained during the print run. The processing, evaluation and storage of the quantity of data accumulated by the optical detection device 11 requires a preferably electronically designed control device 12 having a high processing speed, wherein different interfering factors identified from the data from the optical detection device 11 are evaluated in the control device 12, preferably in process branches that are parallel to one another.

While preferred embodiments of printing machines having at least one machine element that can be adjusted by a setting element, in accordance with the present invention, have been set forth fully and completely hereinabove, it will be apparent to one of skill in the art that various changes in, for example, the specific type of printing machines used, the specific structure of the setting elements, and the like could be made without departing from the true spirit and scope of the present invention which is accordingly to be limited only by the appended claims.

What is claimed is:

1. A printing machine comprising:

a plurality of independently adjustable machine elements;

a corresponding plurality of setting elements for adjusting said plurality of machine elements to affect a quality of printing performed by the printing machine;

an optical detection device having a sensor that is directed toward a surface of a printing substrate printed in the printing machine for detecting the quality of the printing on the printing substrate, said optical detection device being configured to simultaneously detect two marks or measurement fields, which are arranged crosswise to the direction of transport of the printing substrate, are incongruent in a spacing or at least in their respective positions, and are simultaneously assigned to a same color patch;

a control device that receives data from the optical detection device and uses said setting elements to adjust said machine elements based upon a difference between a quality of the printing that is preset as a target value and a quality of the printing that is detected by the optical detection device as an actual value using an identified change in the spacing between the two marks or measurement fields, crosswise to the direction of transport of the printing substrate, in a manner that serves to minimize the difference between the target value and the actual value;

wherein, the adjustment of the different machine elements serves to counteract interfering factors having different causes and different temporal behavior or different surface effects on the printing such that when a difference between the target value and the actual value exists, the control device analyzes the data from the optical detection device with respect to the interfering factor causing the difference, its temporal behavior and/or its surface effect on the printing, and initiates the control operations necessary to achieve the quality of the printing to be produced, these control operations acting upon different ones of the machine elements.

2. The printing machine according to claim 1, wherein at least one of said machine elements is a temperature-control device for controlling the temperature of at least a part of a circumferential surface of a rotational body of the printing machine, wherein said rotational body is involved in the transport of a printing ink to the printing substrate being printed with said ink in the printing machine.

3. The printing machine according to claim 1, wherein said control device is configured to implement the process of adjusting said machine elements continuously during the printing.

4. The printing machine according to claim 1, wherein at least the optical detection device, the control device and at least one of said setting elements are connected to one common data bus.

5. The printing machine according to claim 1, wherein said control device is configured to control at least one guide element arranged in the printing machine for guiding the printing substrate during its transport through the printing machine, or regulate said guide element via one of said setting elements, based upon the data provided by said optical detection device.

6. The printing machine according to claim 5, wherein said control device regulates said guide element via a one of said setting elements for the centering of the printing substrate.

7. The printing machine according to claim 1, wherein at least a first of said machine elements acts upon a mechanical technology and at least a second of said machine elements acts upon properties of a material being used in the printing, including a printing ink, wherein, in the event of a difference between the target value and the actual value, the control device utilizes the first and second machine elements based upon a necessity determined from the data collected by the optical detection device.

8. The printing machine according to claim 1, wherein the control device induces multiple ones of said setting elements and/or machine elements to a joint, coordinated, synergetic reaction on an interfering factor causing the difference in the event of a difference between the target value and the actual value, e.

9. The printing machine according to claim 1, wherein the control device is configured to evaluate different interfering factors identified from the data from the optical detection device in a plurality of parallel process branches.

10. The printing machine according to claim 1, wherein, the control device is configured to use one or more signals to control a web intercept device, based upon the data provided by the optical detection device, when a paper web break is identified.

11. The printing machine according to claim 1, wherein, the control device is configured to use one or more signals to control a web severing device, based upon the data provided by the optical detection device, when a paper web break is identified.

12. The printing machine according to claim 1, wherein the control device is configured to shut down the printing machine based upon the data provided by the optical detection device when a serious interference in a production being implemented with the printing machine is identified.

13. The printing machine according to claim 12, wherein the identified serious interference is a tear in the printing substrate.

14. The printing machine according to claim 1, wherein said control device controls a switch for changing a transport pathway of the printing substrate based upon the data provided by the optical detection device.

15. The printing machine according to claim 14, wherein said switch is configured to feed a printed product identified by the control device to be of good quality to a first delivery and a printed product identified to be of poor quality to a second delivery.

* * * * *